US005580161A

United States Patent [19]

Vakil et al.

[11] Patent Number: 5,580,161

[45] Date of Patent: Dec. 3, 1996

[54] HARD-WIRED FLUORESCENT REPLACEMENT FIXTURE

[75] Inventors: Usman Vakil, Walnut; Henry Arias, Rowland Heights, both of Calif.

[73] Assignee: Lights of America, Inc., Walnut, Calif.

[21] Appl. No.: 278,045

[22] Filed: Jul. 20, 1994

[51] Int. Cl.[6] ..... F21S 5/00

[52] U.S. Cl. ..... 362/260; 362/216; 362/431

[58] Field of Search ..... 362/216, 260, 362/226, 374, 345, 294, 362, 431, 414, 294; 313/318.09, 634, 493; 439/226, 227, 229

[56] References Cited

U.S. PATENT DOCUMENTS

| | | | |
|---|---|---|---|
| 2,069,239 | 2/1937 | Fraser | 362/226 |
| 4,141,061 | 2/1979 | Ford et al. | 362/414 X |
| 4,278,911 | 7/1981 | Metoff | 362/216 X |
| 4,282,563 | 8/1981 | Ohta et al. | 362/226 X |
| 4,498,125 | 2/1985 | Schumaker | 362/414 X |
| 4,549,252 | 11/1985 | Ripley et al. | 362/216 X |
| 4,785,384 | 11/1988 | Zwald et al. | 362/431 X |
| 5,015,917 | 5/1991 | Nigg | 362/260 X |
| 5,249,112 | 9/1993 | Bray | 362/431 X |
| 5,351,174 | 9/1994 | Ewing | 362/260 X |

*Primary Examiner*—Carl D. Price
*Assistant Examiner*—Thomas M. Sember
*Attorney, Agent, or Firm*—Graham & James LLP

[57] ABSTRACT

A fluorescent light fixture has a fluorescent light starter assembly secured within a vented housing. The housing has a base with an electrical connector which feeds the external power to the fluorescent light starter assembly. The base of the housing is secured to a tubular adaptor. The other end of the adaptor is secured to the lamp post. Power is provided to the fluorescent light by an external power supply wire which typically runs from a wall outlet, through the center of the lamp post and the adapter, and to the base of the housing where it is secured to the electrical connectors which provide power to the fluorescent light starter assembly. The adaptor may include a switch for manually turning on and off the fluorescent light starter assembly. The switch is electrically connected to the external power supply wire and the electrical connectors at the base of the housing.

4 Claims, 3 Drawing Sheets

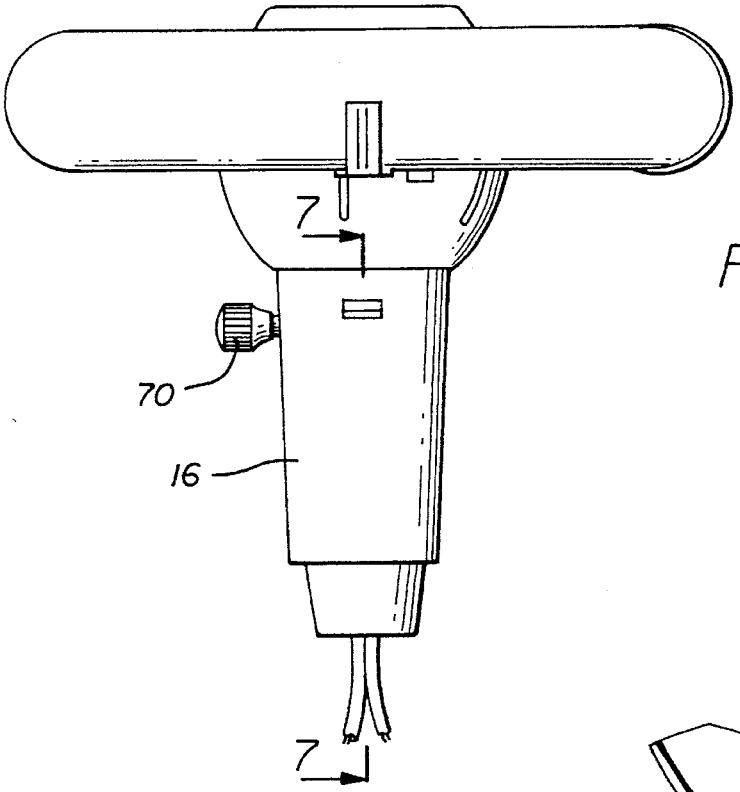
FIG. 6
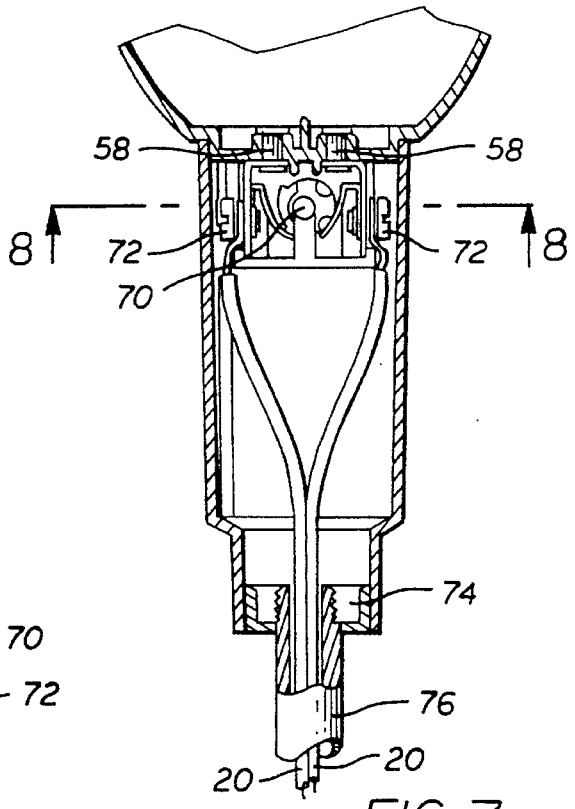
FIG. 7
FIG. 8
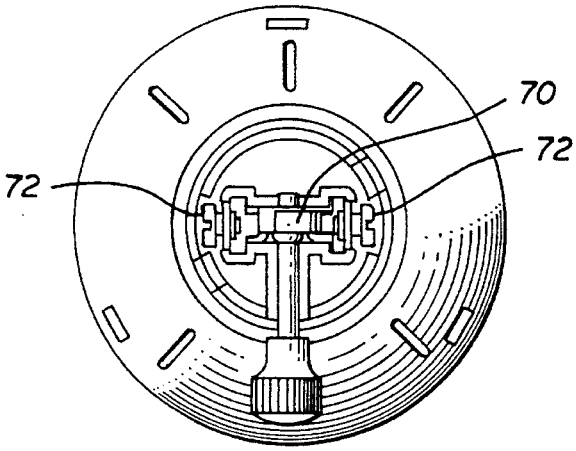

HARD-WIRED FLUORESCENT REPLACEMENT FIXTURE

FIELD OF THE INVENTION

The present invention relates generally to fluorescent light fixtures and, more particularly to a fluorescent light fixture which may be hard-wired into floor and table top lamps, replacing incandescent screw-type fixtures.

DESCRIPTION OF RELATED ART

Fluorescent lamps operate at a significant cost-savings in electricity over typical incandescent lamps. Industrial users have taken advantage of these cost savings by installing fluorescent lamps wherever possible. Initially, due to the large size of the starter system required to illuminate a fluorescent system, only large overhead or wall mounted systems were implemented. This implementation permitted the installer to maintain ambience and provide light at a reduced cost while concealing the cumbersome starter system in the wall or ceiling.

Technological innovations which made it possible to reduce the size of a fluorescent starter system have led to a revolution in fluorescent lighting options. Owners of floor and table top lamps having incandescent, screw-type fixtures may now install a fluorescent light fixture adapter to convert the lamp into a fluorescent lamp. The adapter simply screws into the existing lamp screw-type fixture to permit the installation of a fluorescent bulb. The existing lamp is used as before, but provides similar illumination for a reduced operating cost.

The implementation of the fluorescent light adapters has met with mixed success and failure. Although successful in home use, use in certain industrial settings, such as in a hotel, has created an unforeseen drawback as a result of the fluorescent light adapter's ease of removal. A hotel worker or patron, for example, recognizing the utility of the adapter in his or her own home, may easily remove the adapter as easily as it was installed. The worker or patron may then take the adapter home for personal use.

The removal of installed adapters creates a variety of problems for the hotel operator. The hotel operator loses the cost of the adapter and the fluorescent bulb, which may be significant. The hotel also loses the benefit of the reduced operating cost of each lamp that has been converted to fluorescent use. A severe problem may also develop with respect to the hotel operator's arrangement with the local utility. A hotel operator may reduce operating costs by committing to a program of energy conservation in exchange for a rebate from the local utility. The installation of fluorescent adapters and fluorescent tubes may form part of the hotel's program to reduce electricity consumption. If a significant number of the adapters are later removed, the hotel operator may lose the rebate from the local utility.

Other electric utility rebate programs tied to fluorescent light use can also be circumvented by switching back to incandescent from fluorescent fixtures. For example, a homeowner could take advantage of a local rebate by installing a fluorescent adaptor and simply remove the adaptor once the rebate has been received.

Thus, there is presently a need for a fluorescent light fixture of the same general size and shape as an incandescent screw-type fixture and which may be hard-wired into a floor or table top lamp during manufacture in order to replace the incandescent screw-type fixture.

SUMMARY OF THE INVENTION

The present invention is concerned with solving the above-noted difficulties with a fluorescent light fixture of the same general size and shape as an incandescent screw-type fixture and which may be hard-wired into a floor or table top lamp during manufacture in order to replace the incandescent screw-type fixture.

In accomplishing this objective, there is provided a fluorescent light fixture which includes a fluorescent light starter assembly secured within a vented housing. The housing has a base with an electrical connector which feeds external power to the fluorescent light starter assembly from an external power source such as a wall outlet. The base of the housing is secured to a tubular adaptor. The other end of the adaptor is threaded and may be secured to the threaded end of a typical hollow table top or floor lamp post simply by rotating the threaded end of the adaptor and capturing the threaded lamp post. Power is provided to the fluorescent light by an external power supply wire which typically runs from a wall outlet, through the center of the lamp post and the adapter, and to the base of the housing where it is secured to the electrical connectors which provide power to the fluorescent light starter assembly.

In an alternate embodiment, the adaptor includes a switch for turning on and off the fluorescent light starter assembly. The switch is electrically connected to the external power supply wire and the electrical connectors at the base of the housing. The switch permits the user to manually connect or disconnect the fluorescent light starter assembly from the external power.

A more complete understanding of the hard-wired fluorescent replacement fixture may be afforded to those skilled in the art, as well as a realization of additional advantages thereof, by a consideration of the following detailed description of the preferred embodiment. Reference will be made to the appended sheets of drawings in which like reference numbers refer to like elements.

DETAILED DESCRIPTION OF THE DRAWINGS

FIG. 6 is a side view of an internally switched embodiment of the fluorescent replacement fixture of the present invention;

Figure 1:
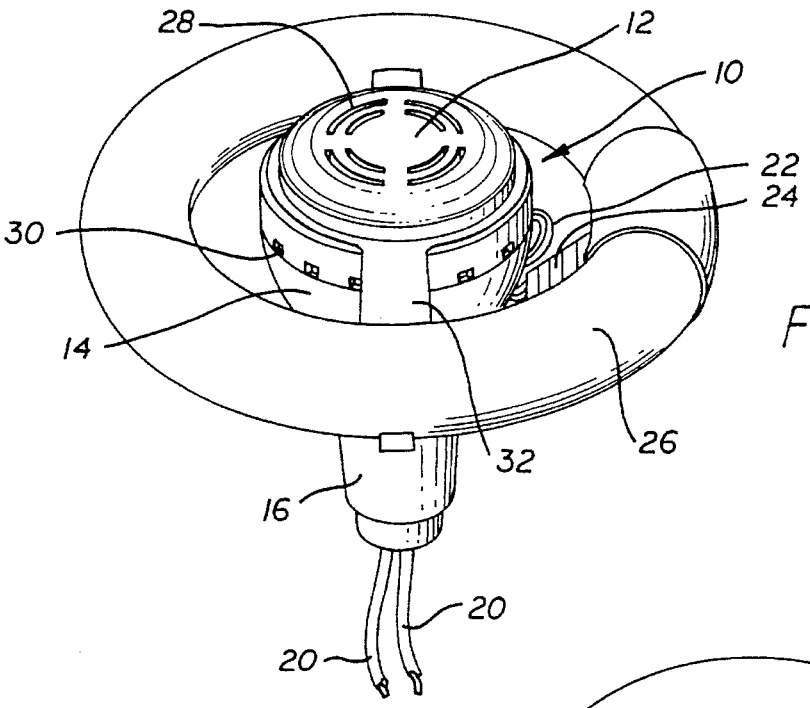
FIG. 1 is a top perspective view of an externally switched embodiment of a fluorescent replacement fixture in accordance with the present invention.

FIG. 7 provides a cut-away side view of the internally switched embodiment taken along line 7—7 of FIG. 6.; and FIG. 8 is a cut-away bottom view of the internally switched embodiment taken along line 8—8 of FIG. 7.

DETAILED DESCRIPTION OF THE PREFERRED EMBODIMENT

A detailed description of the present invention will now be presented in conjunction with FIGS. 1–8. It should be understood that the drawings are merely illustrative, and that the present invention is in no way limited to the embodiments shown in the drawings.

FIG. 1 depicts a fluorescent replacement fixture which may be switched on and off by an externally switched power supply. The fluorescent replacement fixture includes a starter assembly housing 10 preferably formed of a low weight, heat resistant plastic. The starter assembly housing includes a starter assembly housing cover 12 which is secured to a starter assembly housing base 14. The starter assembly housing is supported by and secured to a lamp post by the starter assembly adapter 16.

The starter assembly housing 10 contains the starter and ballast circuits required (not shown) to properly transform household AC current from an input such as external power wires 20 and to provide the proper power through electrical wires 22 and electrical connector 24 to the fluorescent tube 26. The fluorescent tube is supported by the fluorescent tube support bracket 32 which is integrally formed with the starter assembly housing cover 28. The heat generated by the starter and ballast circuits is vented from the starter assembly housing 10 through cover top vents 28 and cover side vents 30.

Figure 2:
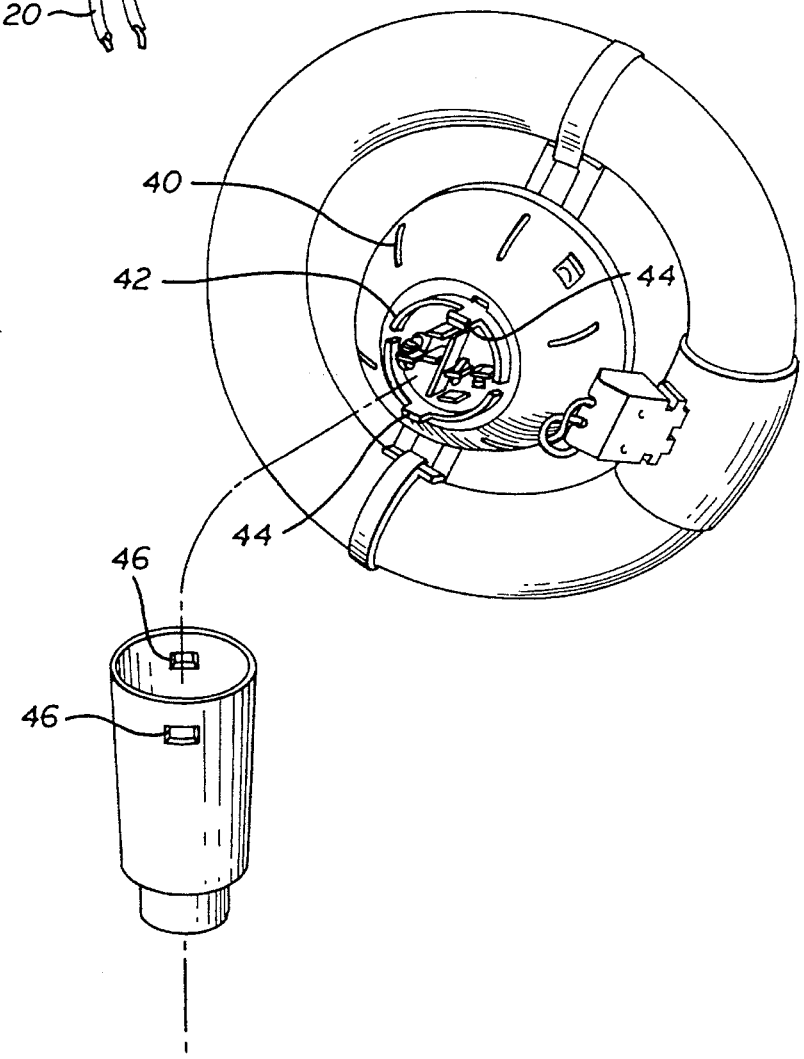
FIG. 2 is a bottom perspective view of the fluorescent replacement fixture of FIG. 1 showing the starter assembly housing base separated from the starter assembly adapter.

FIG. 2 shows that heat may also be vented through base vents 40 which are provided in the starter assembly housing base 14. The bottom of the base 14 includes a starter assembly base support ring 42 which frictionally fits within the starter assembly adapter 16. The support ring includes starter assembly support ring clips 44 which are inserted into starter assembly adapter slots 46 when the starter assembly housing base 14 is inserted into the starter assembly adapter 16. When the support ring is fully engaged into the adapter 16 the clips 44 engage the slots 46 and secure the starter assembly housing base 14 to the starter assembly adapter 16. The starter assembly adapter 16 may be secured to the lamp post by a threaded end (not shown) through which the electrical power wires are provided or any equivalent means typically used to secure a light fixture to a lamp post in table top and floor lamps.

Figure 3:
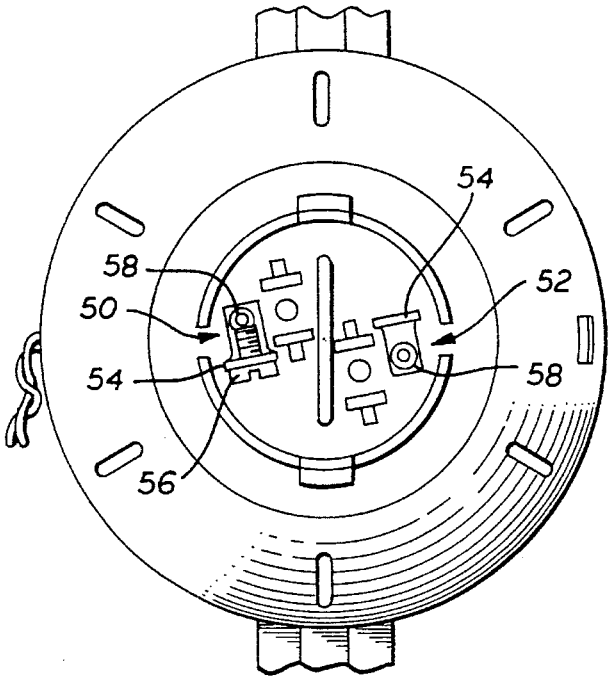
FIG. 3 is a bottom view of the starter assembly housing base showing a threaded bracket connector embodiment of the electrical connector of the present invention.

As seen in FIG. 3, the starter assembly housing base 14 provides electrical connectors 50 and 52 within the starter assembly base support ring 42. The electrical connectors, in one embodiment, provide external power from external power wires 20 to the starter assembly through a conductive L-shaped support bracket 54. The external power wires 20 are secured to the L-shaped support bracket by threaded screw 56. Electrical connector 50 shows a threaded screw 56 installed within the L-shaped support bracket. Electrical connector 52 shows the L-shaped support bracket with the threaded screw removed. The L-shaped support bracket 54 is secured to the starter assembly housing base by an electrically conductive rivet 58. Power may be provided to the starter assembly from external power wires 20 through the L-shaped support bracket 54 and through conductive rivet 58. The first end of the rivet 58 is secured to the L-shaped support bracket 54. The second end of the rivet is secured to an electrical wire inside the starter assembly housing which provides power to the starter assembly (not shown). Internal connections between the rivets and the starter assembly are known in the art. Therefore external power provided to the conductive L-shaped support bracket 54 is provided to the starter assembly via the conductive rivet 58.

Figure 4:
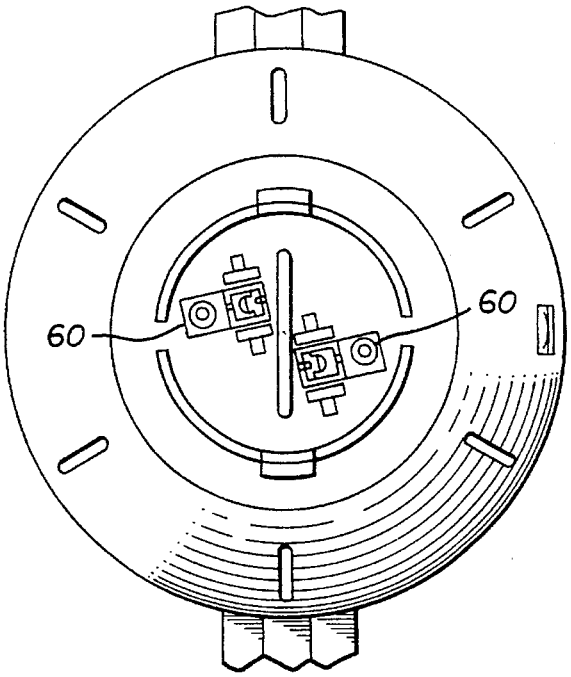
FIG. 4 is a bottom view of the starter assembly housing base showing a splicing connector embodiment of the electrical connector of the present invention.

In FIG. 4, the starter assembly housing base 14 provides electrical connectors 60 within the starter assembly base support ring. The electrical connectors provide external power from external power wires 20 to the starter assembly through a conductive splicing connector 62 as shown in FIG. 5.

Figure 5:
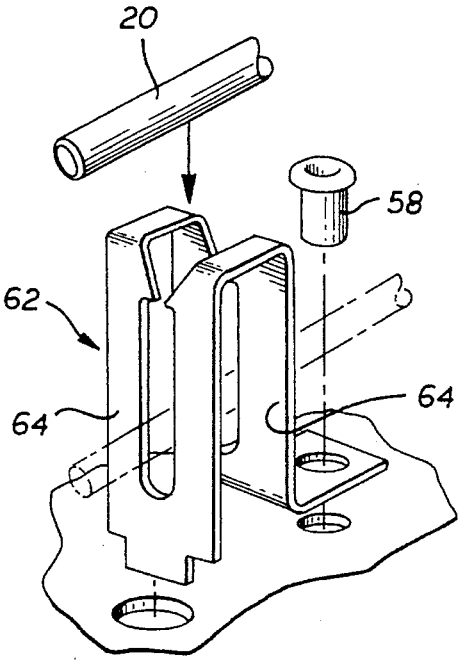
FIG. 5 is a detailed perspective view of the splicing connector shown in FIG. 4.

As shown in detail in FIG. 5, as the end of external power wire 20 is forced down between sharp tines 64 of the splicing connector, the insulating material covering the wire is cut such that the tines 64 are in a conductive relationship with the internal wire. The tines 64 therefore serve to conductively secure the external power wire 20 in the connector 60.

The conductive splicing connector 60 is secured to the starter assembly housing base 14 by an electrically conductive rivet 58. Power may be provided to the starter assembly from the external power wires through the conductive splicing connector 62 and through conductive rivet 58. The first end of the rivet is secured to the L-shaped support bracket 54. The second end of the rivet is secured to an electrical wire inside the starter assembly housing which provides power to the starter assembly (not shown) as discussed above. Therefore external power provided to the conductive splicing connector is provided to the starter assembly via the rivet.

In FIG. 6, the fluorescent tube may be manually switched on and off by a switch 70 which is located within the starter assembly adapter 16 of the fluorescent replacement fixture. As seen in more detail in FIGS. 7 and 8, the external power wires 20 are secured to the switch 70 via screws 72. As the switch 70 is manually rotated, power from external power wires 20 is connected to the starter assembly via rivets 58.

The starter assembly base support ring 42 frictionally engages the inner circumference of the starter assembly adapter 16. In addition, the starter assembly support ring clips 44 engage the starter assembly adapter slots 46 to further secure the starter assembly housing base 14 to the starter assembly adapter 16. The threaded base 74 of the starter assembly adapter 16 may be secured to a standard lamp post 76 by placing the threaded base 74 onto the lamp post 76 and rotating the threaded base, thereby capturing the lamp post within the threaded base. The threaded base 74 also provides a conduit from the external power source to the starter assembly for the external power wires 20.

In addition to supporting the starter assembly, the starter assembly adapter 16 also serves as an adapter which may be varied to meet the needs of the lamp manufacturer. A longer starter assembly adapter 16 may be provided to replace an elongated incandescent screw-type fixture. Similarly, if the original design used a shorter incandescent screw-type fixture, a shorter starter assembly adapter may be provided in order to permit the manufacturer to maintain a consistent design.

As can be seen, it would be advantageous to replace the screw-type fluorescent light adapter with a hard-wired fluorescent replacement fixture to prevent removal. Hotels generally have the same complement of furniture in each room and each room is identical. Therefore, as hotel operators order replacement fluorescent lamps, it is important that the hard-wired fluorescent replacement fixture be approximately the same height and width as the incandescent fixture within the lamp it is planned to replace. Therefore, a lamp supplier could provide the hotel with lamps of the original design, but which contain a fluorescent replacement fixture instead of the original screw-type fixture. This approach results in increased electricity savings and reduced fluorescent adapter losses.

Replacing an incandescent fixture with a hard-wired replacement fixture also permits the manufacturer and customer, such as a purchaser for a hotel, to dictate the wattage of the replacement fluorescent tube. Unlike incandescent bulbs, in which a single size bulb may support a wide range of wattage options, the wattage of a fluorescent tube varies in accordance with tube size. The manufacturer and customer may dictate tube size, and therefore wattage, simply by controlling the size of the fluorescent tube support bracket. This allows the customer to control electricity costs by ordering fluorescent replacement fixtures of a pre-determined size and wattage. By hard-wiring the fluorescent replacement fixture in place, the customer is assured of continued use of the fluorescent tube at a known wattage because the tube cannot easily be changed to a higher power fluorescent tube.

With respect to the manufacture of the device discussed above, all of the components thereof exclusive of the metal electrical connectors, circuit electronics, and the printed circuit board, may be injected molded using a suitable plastic material, for example, lexan. Such manufacturing is known by those skilled in the art.

The electrical connector 24 to the fluorescent tube 26 includes a pair of protruding members (not shown) which serve as a wattage key, i.e., the size and shape of the members are used to code the wattage of the fluorescent tube 26, to prevent fluorescent tubes 26 which have higher power requirements from being used with starter and ballast circuits within the starter assembly housing 10 which do not have sufficient power handling capacity. Wattage keys are a standard interface which is known in the art. The wattage key ensures that the fluorescent tube 26 does not demand more power than can be safely provided from the circuits within the starter assembly housing; and, as a result serves to prevent overheating and reduce the risk of fire.

Having thus described a preferred embodiment of the hard-wired fluorescent replacement fixture, it should be apparent to those skilled in the art that certain advantages of the system have been achieved. It should also be appreciated that various modifications, adaptations, and alternative embodiments thereof may be made within the scope and spirit of the present invention. For example, the externally switched embodiment may use solder to connect the external power wires to the conductive rivets. The internally switched embodiment may employ an alternate switching scheme such as a sliding push button switch. As described above, the starter assembly adapter may be provided in a variety of dimensions in order to meet manufacturers specifications.

It is the intention that all such modifications adaptations and alternative embodiments fall within the scope of the present invention, which is best defined by the claims appended below.

I claim:

1. A fluorescent light fixture comprising:

a housing having a fluorescent light starter assembly secured therein;

means for fastening said housing to a lamp post, said fastening means comprising a hollow tubular section having an open end, a threaded base and a side, wherein said side has two slots, said fastening means having an external power supply wire passing therethrough; and means for supporting a fluorescent light tube proximate said housing, wherein said housing further comprises:

a base having electrical connectors for connecting said external power supply wire to said starter assembly secured within said housing;

a support ring having clips secured to said base of said housing, wherein said support ring and said clips frictionally engage said tubular section and said slots; and a vent to provide air flow within said housing.

2. A fluorescent light fixture comprising:

a housing having a fluorescent light starter assembly secured therein;

means for fastening said housing to a lamp post, said fastening means having an external power supply wire passing therethrough; and means for supporting a fluorescent light tube proximate said housing, wherein said fastening means further comprises:

a hollow tubular section having an open end, a threaded base and a slotted side; and a switch secured to said side of said tubular-section for turning on and off said fluorescent light tube, said switch electrically connected to said external power supply wire.

3. The fluorescent light fixture of claim 2 wherein said housing further comprises:

a base having electrical connectors for connecting said starter assembly secured within said housing to said switch secured within said fastening means;

a support ring having clips secured to said base of said housing, wherein said support ring and said clips frictionally engage said tubular section and said slots; and a vent to provide air flow within said housing.

4. A fluorescent light fixture for hard-wiring to a lamp, the fluorescent light fixture comprising:

a housing having a fluorescent light starter assembly secured therein;

means for supporting a fluorescent light tube proximate said housing; and means for fastening said housing to a lamp post, said fastening means having an external power supply wire passing therethrough, wherein said fastening means further includes a hollow tubular section having a first open end, a second threaded end for securing to said lamp post and a side having a plurality of slots proximate said first open end which are used in connecting said housing to said first open end.

* * * * *